US011794489B2

(12) United States Patent
Boniface et al.

(10) Patent No.: US 11,794,489 B2
(45) Date of Patent: Oct. 24, 2023

(54) FACILITY FOR PRINTING OR COATING SURFACES OF THREE-DIMENSIONAL PARTS

(71) Applicants: SMRC AUTOMOTIVE HOLDINGS NETHERLANDS B.V., Amsterdam (NL); ROBO, Chambery (FR)

(72) Inventors: Jérome Boniface, Santes (FR); Romuald Richebourg, Carvin (FR); Michel Demarchi, Culoz (FR)

(73) Assignees: SMRC AUTOMOTIVE HOLDINGS NETHERLANDS B.V., Amsterdam (NL); ROBO, Chambery (FR)

( * ) Notice: Subject to any disclaimer, the term of this patent is extended or adjusted under 35 U.S.C. 154(b) by 0 days.

(21) Appl. No.: 17/252,622

(22) PCT Filed: Jun. 19, 2019

(86) PCT No.: PCT/EP2019/066241
§ 371 (c)(1),
(2) Date: Dec. 15, 2020

(87) PCT Pub. No.: WO2019/243440
PCT Pub. Date: Dec. 26, 2019

(65) Prior Publication Data

US 2021/0300061 A1 Sep. 30, 2021

(30) Foreign Application Priority Data

Jun. 21, 2018 (FR) ..... 18 55490

(51) Int. Cl.
*B41J 3/407* (2006.01)
*B41J 11/00* (2006.01)
*B41J 25/304* (2006.01)

(52) U.S. Cl.
CPC ..... *B41J 3/4073* (2013.01); *B41J 11/00214* (2021.01); *B41J 25/304* (2013.01)

(58) Field of Classification Search
CPC ..... B41J 3/40731
See application file for complete search history.

(56) References Cited

U.S. PATENT DOCUMENTS

2010/0302304 A1* 12/2010 Bauer ..... B41J 3/40731 347/20
2013/0257984 A1* 10/2013 Beier ..... B41J 3/4073 347/37

(Continued)

FOREIGN PATENT DOCUMENTS

GB 2448690 A * 10/2008 ..... B41J 11/46
JP H05293955 11/1993

(Continued)

OTHER PUBLICATIONS

International Search Report dated Aug. 22, 2019.
International Office Action dated Jan. 3, 2023.

*Primary Examiner* — Shelby L Fidler
(74) *Attorney, Agent, or Firm* — IPSILON USA, LLP

(57) ABSTRACT

The present invention concerns a facility (1) for printing surfaces of parts comprising: —apart support (3) mounted on a movement device (4) having at least five degrees of freedom, —at least one spray printing head and means (8) for sensing speeds and/or coordinates mounted on a support (11), —means (10) capable of controlling the printing means and the movement device (4), the movement device (4) and the support (11) being arranged opposite each other and a spatial reference frame (X, Y, Z) being assigned to said fixed support structure (11). A printing facility (1) characterised in that the printing means (5) consist of at least two mono- (Continued)

chromatic or bi-chromatic printing heads that are able to rotate and/or move in translation with at least one degree of freedom.

16 Claims, 7 Drawing Sheets

(56) References Cited

U.S. PATENT DOCUMENTS

| | | | | |
|---|---|---|---|---|
| 2013/0342592 | A1* | 12/2013 | Merz | B33Y 30/00 347/2 |
| 2016/0009104 | A1* | 1/2016 | Matsuhashi | B41J 3/4073 347/9 |
| 2017/0341423 | A1* | 11/2017 | Schnepp | B41J 2/16517 |
| 2018/0056671 | A1 | 3/2018 | Boniface | |
| 2019/0337306 | A1* | 11/2019 | Boniface | B41M 7/0081 |

FOREIGN PATENT DOCUMENTS

| | | | | |
|---|---|---|---|---|
| JP | 2002084407 | | 3/2002 | |
| JP | 2010-094882 | | 4/2010 | |
| JP | 2014012240 | A * | 1/2014 | B41J 3/4073 |
| JP | 2014117930 | | 6/2014 | |
| JP | 2015098103 | | 5/2015 | |
| JP | 2016088071 | | 5/2016 | |

* cited by examiner

FACILITY FOR PRINTING OR COATING SURFACES OF THREE-DIMENSIONAL PARTS

RELATED APPLICATION

This application is a National Phase of PCT/EP2019/066241 filed on Jun. 19, 2019 which claims the benefit of priority from French Patent Application No. 18 55490, filed on Jun. 21, 2018, the entirety of which are incorporated by reference.

FIELD OF THE INVENTION

The present invention relates generally to the field of the treatment and coating of part surfaces by an automated installation, in particular spray printing of patterns on surfaces of complex forms, notably three-dimensional, and its subject is an installation for printing and/or coating such part surfaces, preferentially by implementing inkjet-type printing means.

The parts concerned can notably consist of automobile interior cladding parts.

DESCRIPTION OF RELATED ART

As is known and as illustrated, for example, by the publications DE 10 2012 212 469 A1, US 2009/0167817 A1, EP 2 873 496 A1 and EP 0 931 649 A1, to print a part by printing means of inkjet type, the print head which ejects the coating substance, such as the ink, can be displaced by a robotized arm relative to a part which remains fixed.

However, the printing means, which more often incorporates a quadrichrome assembly, are generally bulky, and moving them is then complicated, especially at high speed. That is all the more true when these printing means are, in addition, associated with a module for at least partially drying drops of the substance deposited on the surface, disposed directly under the print head. Furthermore, the print heads can be subject to disturbances or to position variations because of the rapid displacement of the robotized arm. To limit these disturbances, it is then necessary to limit the speed of displacement of the robotized arm, which reduces the rate, and the industrial efficiency. Moreover, abrupt variations of the orientation of the print head cause the quality of the printing to be affected. Indeed, inside the print head, the air is at a slight vacuum pressure to prevent the substance from flowing through gravity. Now, abrupt variations of orientation cause the balance between atmospheric pressure and the pressure inside the print head to be modified, and therefore disturb the ejection of the substance. Finally, it is also difficult to mount the print head substance supply unit on the robotized arm.

To mitigate these drawbacks, it has been proposed, in particular by the applicant in its French patent applications no. 17 50260, no. 17 51064 and no. 18 54024, to implement installations in which the print head and the drying means are fixed, that is to say immobile and static, and only the part is displaced during the printing, by being mounted on a multi-axis robotized arm.

In these installations also, the printing means consist of a single quadrichrome color print head which, seen from the front, generally shows a configuration of the nozzles or orifices for ejection of the different colors as represented in FIG. 1 (B=black; Y=yellow; C=cyan; M=magenta).

These orifices are arranged in rows that are superposed vertically (axis Z) with an alternation of the colors sprayed and the separation "e" between nozzles of the same color, belonging to two successive rows of nozzles of the stack, determines the resolution of the printing.

Such a quadrichrome print head does however present a certain number of drawbacks as indicated hereinbelow.

Thus, it has a significant bulk (height) in the direction Z (generally vertical direction). This characteristic leads to problems of print quality and uniformity because of the variations of speed of displacement of the part (secured to the robot arm). Furthermore, because of the colorwise alternation of the rows of nozzles, the relatively significant distances separating two successive rows delivering the same color make the mutual synchronization of these rows of nozzles of the same color difficult. Because of this, the resulting print quality on the three-dimensional surfaces is not optimal. Finally, the order of succession of the colors is imposed physically by the color assignment of the rows of nozzles and the limited resolution of the quadrichrome head requires several printing passes to be performed to obtain a good print quality, hence a significant loss of time.

Through the document U.S. Pat. No. 9,266,354, a printing installation is known that comprises a plurality of bichromatic or monochromatic print heads and drying/crosslinking means mounted according to a circular disposition on a fixed support structure.

The part being decorated is, for its part, displaced in front of the print heads and the drying/crosslinking means, by a support device comprising a first translational displacement unit and second and third units for displacement in rotation, about pivoting axes that are not parallel to one another and one of which coincides with the axis of translation of the first unit.

This installation has a complex and relatively bulky structure, with, in addition, a significant limitation in terms of varieties of forms of three-dimensional surfaces that can be treated. Finally, it offers a multitude of printing and drying positions, corresponding to the different positions of the abovementioned heads and means.

OBJECTS AND SUMMARY

The aim of the present invention is to mitigate at least the main drawbacks stated above.

To this end, its subject is an installation for printing and/or coating surfaces of parts, in particular three-dimensional surfaces, this installation essentially comprising:

- a part support, capable of receiving and holding a part to be decorated or to be coated and mounted on a displacement device with at least five degrees of freedom, such as, for example, a six-axis robot arm,
- ink spray or similar printing means, consisting of at least one print head,
- sensor means, capable of measuring parameters of positioning and/or of displacement of the part, in particular speeds of displacement and/or positioning coordinates,
- possibly means for at least partially drying and/or crosslinking substances sprayed onto the surface of the part to be decorated,
- computation, management and control means that are able and are intended to exploit the signals delivered by the sensor means and to control at least the printing means and the displacement device, the printing means, the sensor means and the possible drying means being arranged side-by-side, for example superposed, on a fixed support structure, such as a baseplate, an upright, a boom or the like, the displacement device and the support structure being disposed mutually facing one another and a spatial reference frame being assigned to said fixed support structure, with a first axis determining the distance between the displacement device and said support structure, a second axis corresponding to the direction of stacking of the printing, sensor and possibly drying means and a third axis at right angles to the preceding two axes, said printing installation being characterized in that the printing means consist of at least two monochromatic or bichromatic print heads that are movable, in rotation and/or in translation, with at least one degree of freedom, said heads being able to be displaced selectively, one by one, to a determined spatial position allowing the printing of the surface of the part, this being done under the control of the computation, management and control means, and in accordance with preprogrammed data, for example a printing program, also determining the displacement of the part relative to the support structure and to the determined spatial position.

BRIEF DESCRIPTION OF THE DRAWINGS

The invention will be better understood, from the description hereinbelow, which relates to preferred embodiments, given as nonlimiting examples, and explained with reference to the attached schematic drawings, in which.

DETAILED DESCRIPTION

Figure 2:
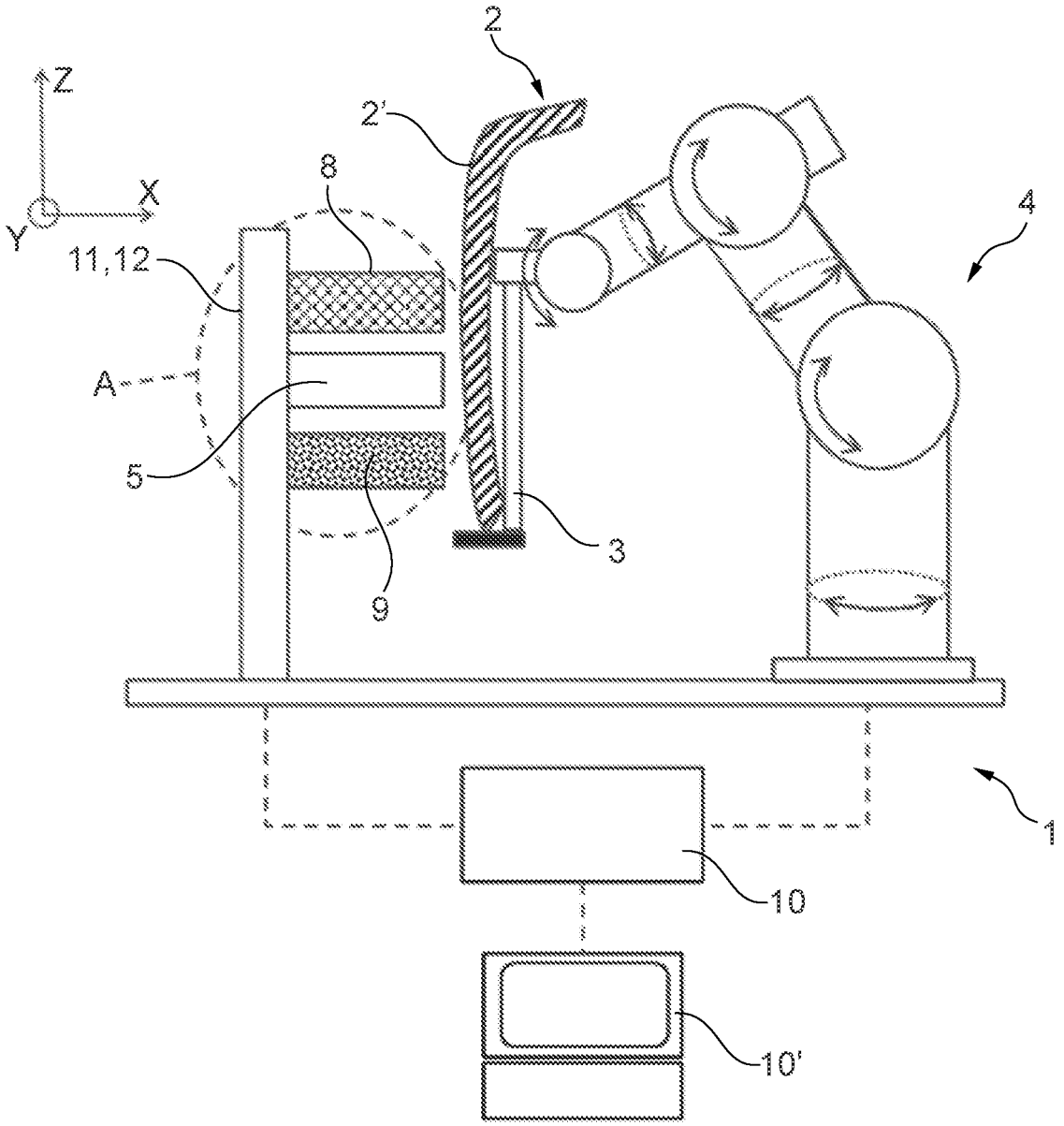
FIG. 2 is a schematic overview in side elevation of a printing installation according to an embodiment of the invention.
Figure 11:
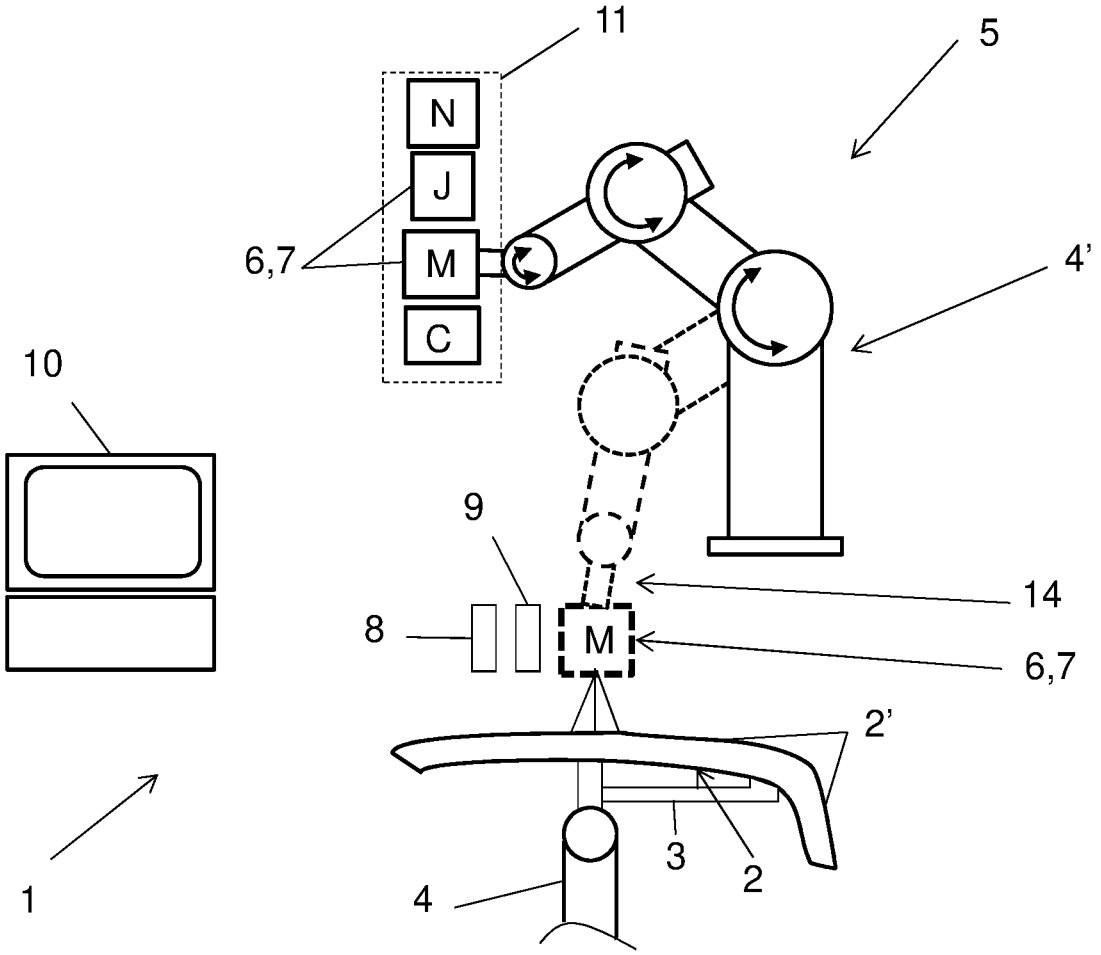

FIGS. 2 and 11 show an installation 1 for printing and/or coating surfaces 2' of parts 2, in particular non-flat or three-dimensional surfaces, this installation 1 essentially comprising:

- a part support 3, capable of receiving and holding a part 2 to be decorated or to be coated and mounted on a displacement device 4 with at least five degrees of freedom, such as, for example, a six-axis robot arm,
- ink spray or similar printing means 5, consisting of at least one print head 6 or 7,
- sensor means 8, capable of measuring parameters of positioning and/or of displacement of the part 2, in particular speeds of displacement and/or positioning coordinates,
- possibly means 9 for at least partially drying and/or crosslinking substances sprayed onto the surface 2' of the part 2 to be decorated,
- computation, management and control means 10 that are able and are intended to exploit the signals delivered by the sensor means 8 and control at least the printing means 7 and the displacement device 4.

The printing means 7, the sensor means 8 and the possible drying means 9 are arranged side-by-side, for example superposed, on a fixed support structure 11, such as a baseplate, an upright, a boom or the like.

The displacement device 4 and the support structure 11 are disposed mutually facing one another and a spatial reference X, Y, Z is assigned to said fixed support structure 11, with a first axis X determining the distance between the displacement device 4 and said support structure 11, a second axis Z corresponding to the direction of stacking of the printing, sensor and possibly drying means 5, 8, 9, and a third axis Y at right angles to the preceding two axes X and Z.

In accordance with the invention and as emerges from FIGS. 3 to 10, printing means 5 consist of at least two monochromatic 6 or bichromatic 7 print heads that are movable, in rotation and/or in translation, with at least one degree of freedom, said heads 6, 7 being able to be displaced selectively, one by one, to a determined spatial position PSD allowing the printing of the surface 2' of the part 2, this being done under the control of the computation, management and control means 10, and in accordance with preprogrammed data, for example a printing program, also determining the displacement of the part 2 relative to the support structure 11 and to the determined spatial position PSD.

By virtue of the abovementioned provisions, the invention makes it possible to dispense with drawbacks associated with a multicolor print head that is very bulky on the axis of stacking of the means 5, 8, 9 (axis Z in the figures) and in which the rows of nozzles of the same color are spaced apart accordingly.

Furthermore, the definition, for the different heads 6, 7 of the means 5, of a single spatial position PSD allowing the printing makes it possible to simplify and make more accurate the kinematic of relative displacement and positioning of the different heads 6, 7 with respect to the part 2 in motion while the printing is in progress.

Figure 8:
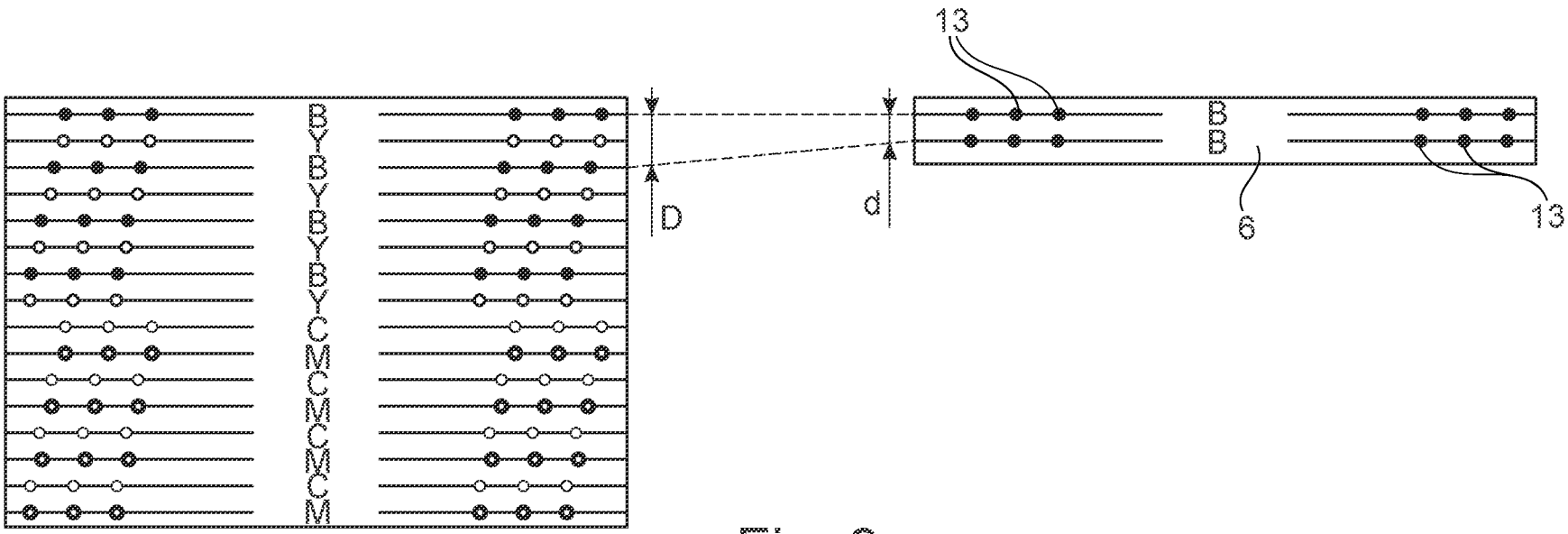
FIG. 8 illustrates, schematically and comparatively, respectively the distances D and d between rows of nozzles for spraying one and the same color, in relation to a quadrichrome print head according to the state of the art and in relation to a monochromatic print head according to the invention.
Figure 9B:
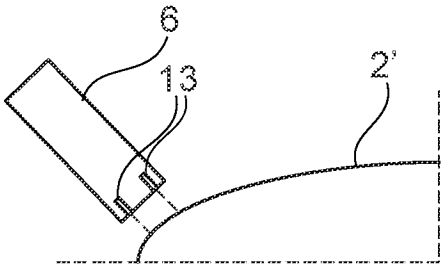
FIGS. 9A and 9B schematically illustrate the gaps between two rows of nozzles and the resulting deviations in terms of print resolution on a non-flat surface, for a quadrichrome head of the state of art (9A) and for a monochromatic head according to the invention (9B)
Figure 9A:
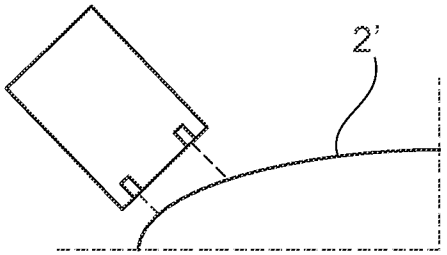
Figure 10:
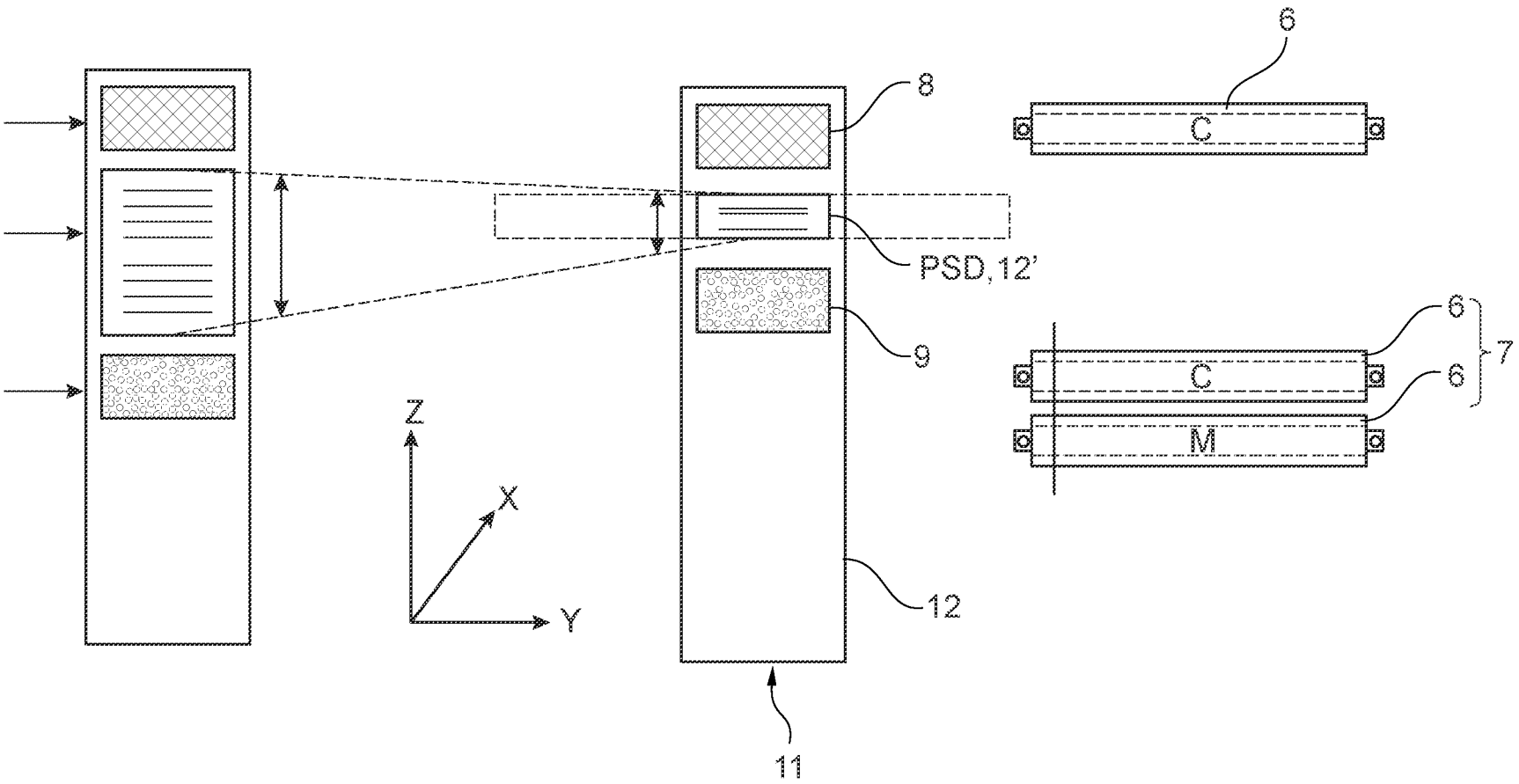
FIG. 10 schematically illustrates, by means of front views of the support structures of a printing illustration, the differences in vertical bulk between a quadrichrome head of the state of the art (on the left) and a monochromatic head (single or double bichromatic), according to the invention (on the right), and, FIG. 11 schematically illustrates, in the form of a partial overview, another embodiment of a printing installation according to the invention.

Finally, by allowing the rows of similar nozzles or ejection orifices 30, allocated to the same color, to be brought closer together, the resolution obtained will be significantly higher (see FIGS. 8 to 10). The position PSD is normally aligned and immediately adjacent with those of the sensor and drying means 8 and 9 for a greater constructional simplicity and better efficiency.

In the embodiment of FIG. 2, and in the variants of FIGS. 3 to 7, the print heads 6, 7 remain at least partially in the support structure 11 although they are movable with respect to the latter.

In accordance with a first variant embodiment and as illustrated in FIG. 3, the print heads 6, 7 can be arranged side-by-side linearly on the third axis Y and be able to be moved together by sliding along this axis Y, this being done under the effect of a suitable translational actuator driven by the computation, management and control means 10.

The different monochrome heads 6 can form part of one and the same module forming a multiple head 5 in bar form, and be arranged in a row in a horizontal direction (axis Y in the figures), therefore with a minimal vertical bulk (axis Z in the figures). The guiding of the block of heads 6 in translation can be done using a rail, a runner or the like forming part of the structure 11.

The sensor means 8 and drying means 9 are normally fixedly mounted on said structure 11, but can also be provided to be movable, like the print heads 6, to even further increase the processing accuracy.

Figure 1:
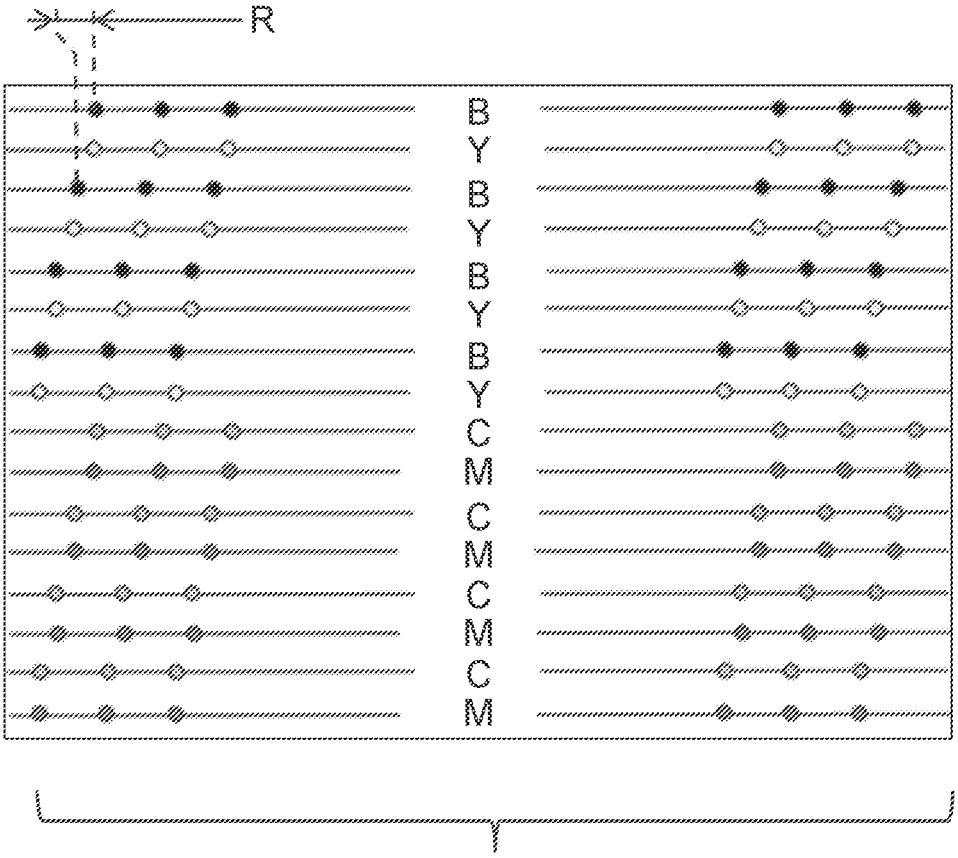
FIG. 1 is an image of a prior art single quadrichrome color print head illustrating a configuration of the nozzles or orifices for ejection of the different colors (B=black; Y=yellow; C=cyan; M=magenta).
Figure 3C:
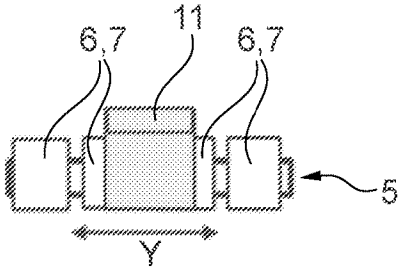
FIGS. 3A to 3C are partial views in side elevation (3A), in front elevation (3B) and from above (3C) of the detail A of FIG. 2, corresponding to the part of the installation combining the printing, sensor and drying means, in accordance with a first variant embodiment of the invention (translational displacement, on an axis, of the aligned print heads)
Figure 3B:
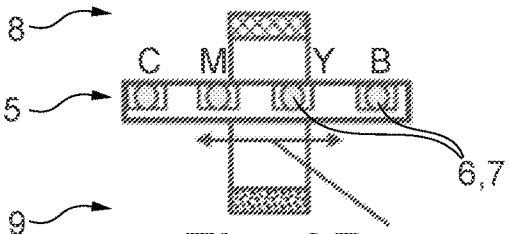
Figure 4B:
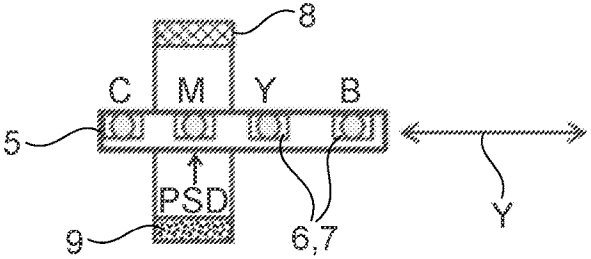
FIGS. 4A and 4B illustrate, with views similar to that of FIG. 3B, two consecutive printing sequences with two monochromatic heads of different colors.
Figure 3A:
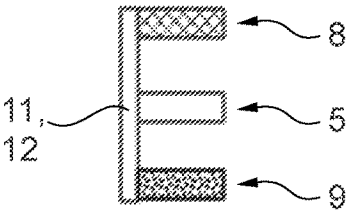
Figure 4A:
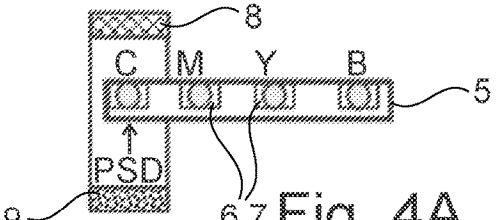

FIGS. 4A and 4B illustrate two successive procedural steps of a process for printing a surface 2' using an installation 1 according to FIG. 1 and comprising printing means 5 according to FIGS. 3A to 3C.

In the first step (FIG. 4A), the print head 6, 7 assigned to the color cyan is positioned by translation on the axis Y (horizontal direction) vertical to and in the axis of the sensor means 8 and the drying/crosslinking means 9 (position PSD). The multi-axis robot arm 4 displaces the part 2 in front of said head 6, 7 which sprays cyan-colored ink onto the surface 2' to be printed according to a predefined printing program, executed by the computation, management and control means 10 which also exploit the information supplied by the sensor means 8 concerning the relative position and the displacement parameters of the part 2.

The drying/crosslinking means 9 ensure the fixing and the at least partial solidifying of the deposited drops.

Under the control of the means 10, the multiple head 5 in bar form is then displaced by one notch, driven via a linear actuator (not represented), so that the head 6, 7 assigned to the color magenta is in the position PSD. Once again, ink is sprayed according to a predefined program while the part 2 is displaced in front of the active head 6, 7 (magenta head) and the drops are dried by the means 9. These steps are then repeated for the other two colors, to complete the printing cycle.

Possibly, all of the printing cycle can be repeated with a very low deliberate offset of the print heads 6, 7 (with respect to their position during the preceding printing cycle), in order to obtain an even better resolution.

Figure 5A:
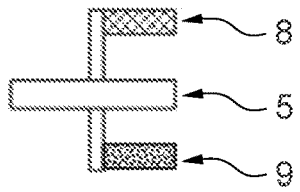
FIGS. 5A to 5C are partial views in side elevation (5A), in front elevation (5B) and from above (5C) of the detail A of FIG. 2, in accordance with a second variant embodiment of the invention (circular distribution and rotational displacement about an axis of the print heads)
Figure 5B:
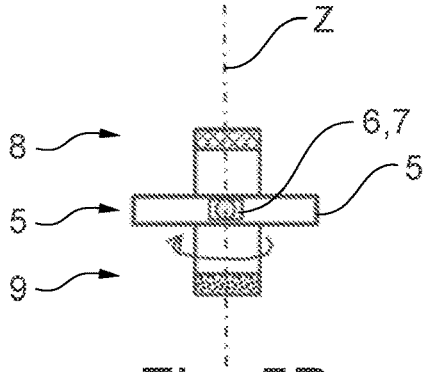
Figure 5C:
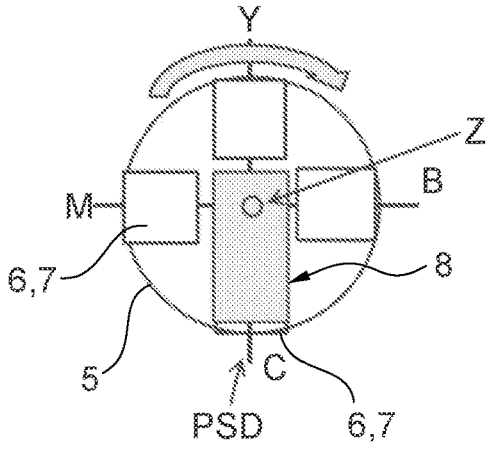

According to a second variant embodiment, illustrated in FIG. 5, provision can be made for the print heads 6, 7 to be arranged circularly about the second axis Z and to be able to be moved together in rotation about this axis Z, this being done under the effect of a suitable rotary actuator (not represented) driven by the computation, management and control means 10.

Like the abovementioned variant, the printing process is performed in successive steps by pivoting the module combining the different heads 6 by a fraction of a turn (here a quarter-turn) about the axis Z.

As previously, the sensor and drying means 8 and 9 are normally fixed, but can be designed to be movable concomitantly with the print heads 6.

According to an additional feature with respect to the abovementioned two variants, and compatible therewith, provision can be made for each of the print heads 6, 7 to be also able to be moved individually, under the effect of a suitable driven actuator (not represented), specific to each head 6, 7 or common to all the heads 6, 7, by sliding on the first axis X (not represented).

The result thereof is a greater flexibility of maneuvering and of application, and a greater mastery, better control and greater flexibility in terms of spray distance.

Figure 6B:
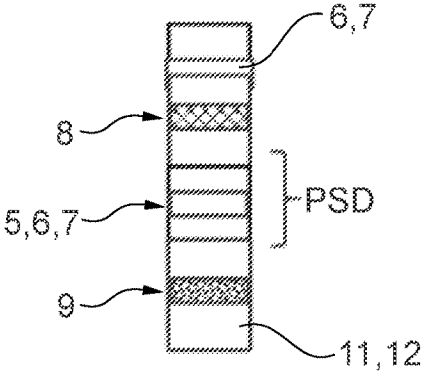
FIGS. 6A and 6B are partial views in side elevation (6A) and front elevation (6B) of the detail A of FIG. 2, in accordance with a third variant embodiment of the invention (translational displacement, in two perpendicular directions, of the aligned print heads)
Figure 6A:
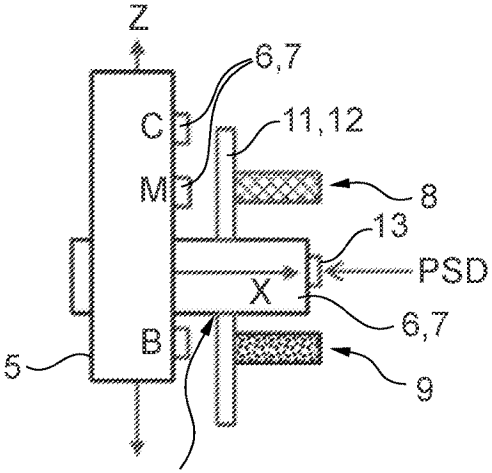

In accordance with a third constructional variant of the invention, represented in FIG. 6, the print heads 6, 7 can be arranged side-by-side linearly on the second axis Z and be, on the one hand, able to be moved together by sliding on this axis Z and, on the other hand, able to be moved individually by sliding on the first axis X, this being done under the effect of suitable translational actuators (not represented) driven by the computation, management and control means 10 (for example a programmable logic controller), with which a control and programming console 10' can be associated.

The sequence for controlling the print heads 6, 7 advantageously comprises, in succession, first of all a sliding on the axis Z for the selection of the color to be applied, then a sliding on the axis X to bring the ejection orifice 13 (nozzle) concerned close to the surface to be decorated.

Figure 7:
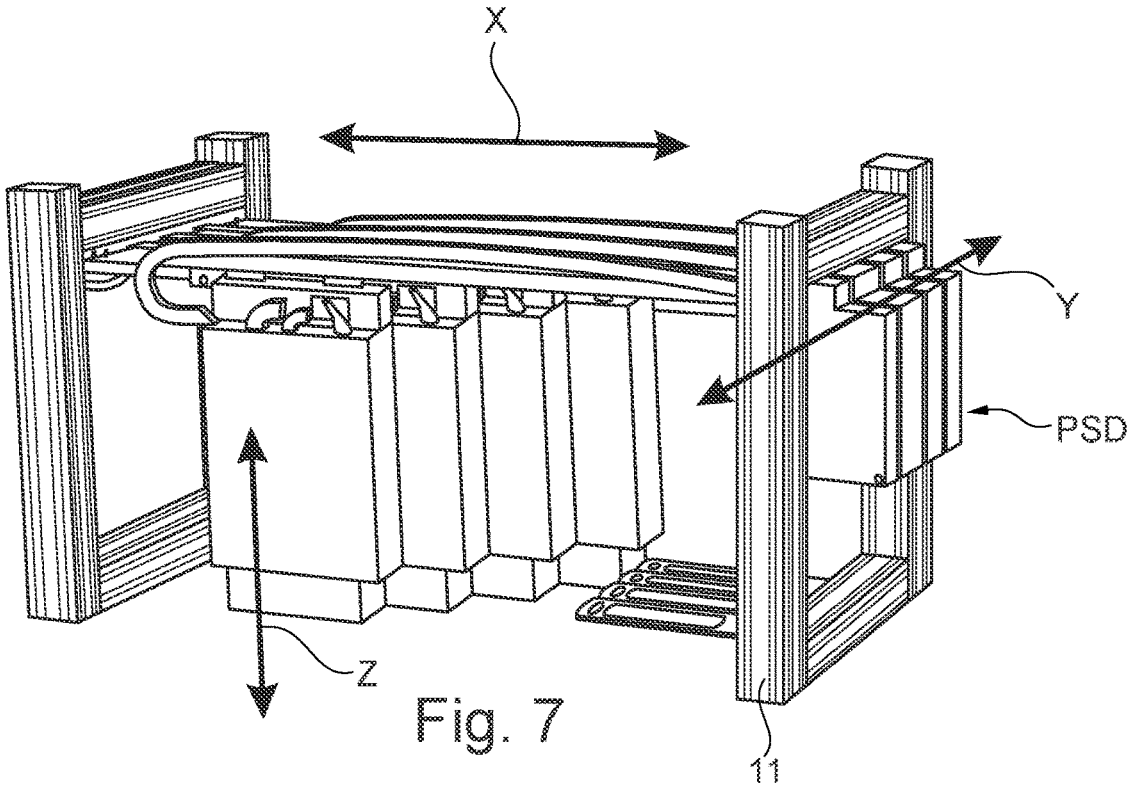
FIG. 7 is a perspective and transparent view of a part of the detail A of FIG. 2, showing the printing means and their housing in this support structure, in accordance with a fourth variant embodiment of the invention (the print heads being able to be displaced in three mutually orthogonal directions)

Finally, and as illustrated in FIG. 7, provision can also be made for the print heads 6, 7 to be mounted on or in the support structure 11 with facility for displacement by sliding, individually, on the three axes X, Y and Z, this being done under the effect of suitable translational actuators driven by the computation, management and control means 10.

The person skilled in the art understands that the vertical Z and horizontal XY orientations represented in the figures are so indicated only by way of the most commonplace example. Indeed, and in accordance with a construction and a suitable orientation of the device 4 for displacing the part 2, these axes X, Y and Z can be inverted, the axis Z then no longer corresponding to the vertical direction (variant not represented).

Advantageously, the support structure 11 is provided with a hood 12 with an aperture 12' constituting the determined spatial position allowing the printing PSD, this aperture 12' allowing the passage of a print head 6, 7 if necessary.

Moreover, given the vertically superposed arrangement of the means 5, 8 and 9, the support structure 11 with the hood 12 advantageously takes the form of a column that is simple and of little bulk.

In accordance with a second embodiment of the installation 1, schematically illustrated in FIG. 11, the support structure 11 consists of a rack or a storage shelving unit for a maintenance station for the print heads 6, 7, and said installation 1 comprises a second displacement device 4' with at least five degrees of freedom, preferentially a second six-axis robot arm, configured to selectively displace a print head 6, 7 from its location in the rack or the storage shelving unit 11 to the determined spatial position PSD, and vice versa, this being done under the control of the computation, management and control means 10. Said print head 6, 7 can be held at this position PSD throughout the progress of the printing or coating operation with this head 6, 7, or possibly be displaced in line with the displacement of the part 2.

Advantageously, the second robot arm 4' is equipped, at its free end, with an automatic tool loader 14, with its automatic driver device, on which can be mounted, temporarily and interchangeably, the print head 6, 7 selected for the planned printing operation, the management of the operation of each printing head 6, 7 and the flow of ink, in line with the possible movements of the supporting robot arm 4' being handled by the means 10.

When it is not in use, each print head 6, 7 is, in this second embodiment of the installation, stored in the support structure 11 (the size and number of receiving locations is matched to the needs in qualitative and quantitative terms).

Each print head 6, 7 can feature ink recirculation or not, the management of the slight vacuum pressures is computerized (means 10) and matched in real time to the movements of the robot 4' and to the orientations of the head 6, 7 concerned.

The mounting of each head 6, 7 on its automatic tool changer 14 allows any orientation of the mounted head to work anywhere in the sphere of action of the robot 4'.

To apply a print color, the robot 4' takes the head 6, 7 of the corresponding color from the storage rack 11 using the automatic tool changer 14.

The parameters for controlling the ink and the print head are advantageously adapted in real time to compensate for the movements of the wrist of the robot 4' when the head is set in motion at the end of the wrist of the robot.

In the context of this second embodiment of the invention, the person skilled in the art will understand that each print head 6, 7 can be used in the following two configurations, namely:

- the head implemented is positioned by the robot as fixed print head (supported part printing principle, the part will be displaced in front of the fixed head by the other robot 4). The possibility of varying the working position set for the morphology of the part to be treated makes it possible to greatly simplify the programming of the trajectories of the robot responsible for the printing trajectories,
- the part 2 is supported by a first robot 4, the print head is supported by a second robot 4' and the two robots 4 and 4' work in collaboration under the control of the means 10. That opens up the possibility of treating much more bulky parts, and on all their faces.

Preferentially, the different print heads 6, 7 all have similar constructions and outer forms.

According to a first embodiment, emerging from FIGS. 3 to 7, the installation 1 preferably comprises four monochromatic print heads 6, each head 6 comprising at least two parallel rows of orifices 13 for ejecting ink of the same color (see in particular FIGS. 8 and 9). When a very high print resolution is sought, each head 6 can, as a variant, comprise only a single row of orifices 13 for a given color.

According to a second embodiment, represented partially in FIG. 10, the installation 1 can comprise two bichromatic print heads 7, each head 7 consisting of the assembly of two monochromatic heads 6 each comprising two rows of orifices 13 for ejecting ink of the same color.

The practical production of the means 4, 4', 5, 8, 9 and 12, and the design of the driving and printing programs, are within the scope of the person skilled in the art, in particular experts in automation and automated printing systems.

Advantageously, the installation 1 can exploit the instantaneous speeds of fractions of the surface 2' of the part 2 in displacement (acquired by the sensor means 8 and exploited by the means 10) to manage the printing cycle, as mentioned in the French patent application no. 18 54024 in the name of the applicant, by way of illustrative example (see FIG. 2 in particular).

Likewise, the drying and/or crosslinking means 9 can advantageously comprise a radiation source with beam adjustment means as described and represented in the French patent application no. 17 50260 in the name of the applicant, by way of illustrative example.

Obviously, the invention is not limited to the embodiments described and represented in the attached drawings. Modifications remain possible, notably from the point of view of the construction of the various elements or by substituting technical equivalents, without departing in any way from the scope of protection of the invention.

The invention claimed is:

1. An installation for printing and/or coating surfaces of parts, said installation comprising:

- a part support, capable of receiving and holding a part to be decorated or to be coated, said part support mounted on a displacement device with at least five degrees of freedom,
- printing means, including at least one print head,
- sensor means, capable of measuring parameters of positioning and/or of displacement of the part, including at least speeds of displacement and/or positioning coordinates,
- drying means for at least partially drying and/or crosslinking substances sprayed onto the surface of the part to be decorated,
- computation, management, and control means that are able to exploit the signals delivered by the sensor means and to control at least the printing means and the displacement device,
- the printing means, the sensor means, and the drying means being arranged side-by-side on a fixed support structure,
- the displacement device and the support structure being disposed mutually facing one another, with a spatial reference frame being assigned to said fixed support structure, with a first axis determining a distance between the displacement device and said support structure, a second axis corresponding to a direction of stacking of the printing means, sensor means, and drying means, and a third axis at right angles to said first and second axes,
- wherein said printing means includes at least two monochromatic or bichromatic print heads that are movable, in rotation and/or in translation, with at least one degree of freedom, said heads being able to be displaced selectively, one at a time, with a selected head being set to a determined spatial position allowing the printing of the surface of the part, said selective displacement being done under the control of the computation, management, and control means and in accordance with preprogrammed data, wherein said computation, management, and control means also determining the displacement of the part relative to the support structure and to the determined spatial position.

2. The installation as claimed in claim 1, wherein the print heads are arranged side-by-side linearly on the third axis and are movable together by sliding on this axis, this being done under the effect of a suitable translational actuator driven by the computation, management and control means.

3. The installation as claimed in claim 2, wherein each of the print heads is also movable individually, under the effect of a suitable driven actuator, specific to each head or common to all the heads, by sliding on the first axis.

4. The installation as claimed in claim 1, wherein the print heads are arranged circularly about the second axis and are movable together in rotation about this axis, this being done under the effect of a suitable rotary actuator driven by the computation, management and control means.

5. The installation as claimed in claim 1, wherein the print heads are arranged side-by-side linearly on the second axis and are, on the one hand, movable together by sliding on this axis and, on the other hand, movable individually by sliding on the first axis, this being done under the effect of suitable translational actuators driven by the computation, management and control means.

6. The installation as claimed in claim 1, wherein the print heads are mounted on or in the support structure with the facility to be displaced by sliding, individually, on the three axes, this being done under the effect of suitable translational actuators driven by the computation, management and control means.

7. The installation as claimed in claim 1, wherein the support structure is provided with a hood with an aperture constituting the determined spatial position allowing printing, this aperture allowing the passage of a print head if necessary.

8. The installation as claimed in claim 1, wherein the support structure includes a rack or a storage shelving unit of a maintenance station for the print heads, and in that said installation comprises a second displacement device with at least five degrees of freedom, configured to selectively displace a print head from its location in the rack or the storage shelving unit to the determined spatial position, and vice versa under the control of the computation, management and control means, said print head being held at said determined spatial position throughout the progress of the printing or coating operation with this head, or being held displaced from said determined spatial position, in line with the displacement of the part.

9. The installation as claimed in claim 8, wherein the second robot arm is equipped, at a free end thereof, with an automatic tool loader having an automatic driver device, on which can be mounted, temporarily or interchangeably, the print head selected for said preprogrammed data that has a printing program, the management of an operation of each print head and the flow of ink during said operation according to said printing program being in line with the possible movements of the supporting second displacement device, being handled by the computation, management and control means.

10. The installation as claimed in claim 8, wherein said second displacement device with at least five degrees of freedom is a six-axis robot arm.

11. The installation as claimed in claim 1, wherein said installation comprises four monochromatic print heads, each head comprising at least two parallel rows of orifices for ejecting ink of the same color.

12. The installation as claimed in claim 1, wherein said installation comprises two bichromatic print heads, each head including the assembly of two monochromatic heads each comprising two rows of orifices for ejecting ink of the same color.

13. The installation as claimed in claim 1, wherein said displacement device with at least five degrees of freedom is a six-axis robot arm.

14. The installation as claimed in claim 1, wherein said printing means is an ink sprayer.

15. The installation as claimed in claim 1, wherein the printing means, the sensor means, and the drying means are arranged side-by-side, superposed on a fixed support structure, said fixed support structure being selected from a baseplate, an upright, and a boom.

16. The installation as claimed in claim 1, wherein said preprogrammed data is printing program.

* * * * *